US008232713B2

(12) United States Patent
Li et al.

(10) Patent No.: US 8,232,713 B2
(45) Date of Patent: Jul. 31, 2012

(54) LAMP CONNECTORS

(75) Inventors: Ming Li, Acton, MA (US); Yi Yang, Peabody, MA (US); Douglas Harriott, Melrose, MA (US); Robert Harrison, North Andover, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/245,796

(22) Filed: Sep. 26, 2011

(65) Prior Publication Data

US 2012/0074831 A1 Mar. 29, 2012

Related U.S. Application Data

(60) Provisional application No. 61/385,989, filed on Sep. 24, 2010.

(51) Int. Cl.
*H01J 5/48* (2006.01)

(52) U.S. Cl. ..... 313/318.01; 313/318.02; 313/318.05; 313/318.12

(58) Field of Classification Search ..... 313/318.01, 313/318.02, 318.05, 318.09, 318.12
See application file for complete search history.

(56) References Cited

U.S. PATENT DOCUMENTS 5,331,734 A * 7/1994 Hunt ..... 29/874
* cited by examiner

*Primary Examiner* — Vip Patel
(74) *Attorney, Agent, or Firm* — Shaun P. Montana; Yiming Zhang

(57) ABSTRACT

Lamp connectors are provided. The lamp connectors include a swinging connector and a rotatable connector. The swinging connector is coupled to a pivot connection point disposed on a first exterior surface of a lamp. The swinging connector is operative to pivot between a first position close in proximity to the lamp and a second position at distance away from the lamp. A portion of the swinging connector may be received and retained by a second exterior surface of the lamp, when the lamp is in the first position. The rotatable connector is attached to an end of a lamp via a rotation mechanism. The rotation mechanism is disposed on the end of the lamp. The rotatable connector includes a surface and a pin protruding therefrom. The pin is offset from a central portion of the end of the lamp.

15 Claims, 2 Drawing Sheets

LAMP CONNECTORS

CROSS-REFERENCE TO RELATED APPLICATION(S)

The present application claims priority of U.S. Provisional Patent Application No. 61/385,989, filed Sep. 24, 2010 and entitled "LAMP AND OTHER LIGHT EMITTING SOURCES CONNECTORS", the entire contents of which are hereby incorporated by reference.

TECHNICAL FIELD

The present invention relates to lighting, and more specifically, to connectors for lamps.

BACKGROUND

Conventional lamps typically connect to a socket to receive power, as well as mechanical support for staying in a particular position. Many lamps include a so-called screw base for this purpose, such as the classic A19 lamp. As an alternative, some lamps use at least pin in place of the screw base, such as a lamp with so-called GU24 pin connectors. Fluorescent lamps traditionally use at least one pin on two sides of the lamp, and more typically, two pins to connect to a socket. This configuration is known as a bi-pin connector.

Even when solid state light sources as used as a light source within a so-called retrofit lamp, such as the LED-based fluorescent-sized retrofit lamps of U.S. Pat. Nos. 7,049,761 and 7,510,299, the retrofit lamp typically retains the typical connector(s) used by the conventional, non-retrofit versions of the lamp. Thus, the retrofit lamps of U.S. Pat. Nos. 7,049,761 and 7,510,299 have at least one bi-pin connector, as is found on conventional fluorescent lamps.

SUMMARY

Conventional lamp connectors, particularly those involving at least one pin, suffer from a variety of deficiencies. Having a pin-type connector complicates packaging for the lamp. A pin is, by definition, a protrusion. Even if the end of the pin is blunt, the pin may puncture surfaces that it comes into contact with. This is particularly troublesome if the surface it comes into contact with is a glass and/or plastic portion of another lamp, as many lamps are typically shipped together simultaneously. Thus, to protect against damage such as described above, the pin(s) in a typical pin-based lamp connector must be surrounded by otherwise additional packaging material that is not necessary with screw base-type connectors. Further, the connector may not allow for movement of the lamp, which may be particularly disadvantageous when the lamp is a retrofit lamp with light sources that do not generate light 360° therefrom.

Embodiments described herein overcome the issues described above with conventional lamp connectors. Embodiments include a swinging connector and a rotatable connector. The swinging connector makes packaging lamps easier than, for example, packaging conventional lamps that include one or more pin connectors protruding from one or more ends of such lamps. Embodiments of the swinging connector do not protrude, except when in use as a connector to a socket, and thus additional costly protection in packaging materials is not necessary. Further, the risks of inadvertent puncture during transportation and/or handling of the lamps are also reduced. The rotatable connector allows the lamp the rotate while remaining in the socket.

In an embodiment, there is provided a lamp. The lamp includes: a first exterior surface and a second exterior surface; a pivot connection point, wherein the pivot connection point is disposed on the first exterior surface; and a swinging connector coupled to the pivot connection point, the swinging connector being operative to pivot between a first position close in proximity to the lamp and a second position at distance away from the lamp.

In a related embodiment, the first exterior surface and the second exterior surface may be adjacent one another. In a further related embodiment, the first exterior surface and the second exterior surface may be substantially orthogonal one another. In yet another related embodiment, the first exterior surface may include a protrusion, and the pivot connection point may be disposed on the protrusion. In still another related embodiment, at least a portion of the second exterior surface may be shaped to receive the swinging connector when the swinging connector is in the first position. In yet still another related embodiment, at least a portion of the second exterior surface may be shaped to receive and retain the swinging connector when the swinging connector is in the first position.

In still yet another related embodiment, the first position may include at least a portion of the swinging connector being flush to the first exterior surface. In a further related embodiment, the first position may include at least a portion of the swinging connector being flush to the second exterior surface. In a further related embodiment, at least a portion of the second exterior surface may be shaped to receive and retain at least a portion of the swinging connector. In yet still another related embodiment, the swinging connector may be electrically connected to the lamp.

In another embodiment, there is provided a lamp. The lamp includes: at least one end, wherein the at least one end includes a central portion; a rotation mechanism disposed on the at least one end; and a rotatable connector attached to the at least one end via the rotation mechanism, the rotatable connector comprising a surface and at least one pin, wherein the at least one pin protrudes from the surface, and wherein the at least one pin is offset from the central portion.

In a related embodiment, the rotation mechanism may be operative to allow the rotatable connector to rotate in relation to the lamp. In another related embodiment, the rotation mechanism may be operative to allow the lamp to rotate in relation to the rotatable connector. In still another related embodiment, the rotation mechanism may be disposed on the at least one end substantially near the central portion. In yet another related embodiment, the rotation mechanism may be disposed on the at least one end offset from the central portion.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

The term "lamp", as used throughout, refers to any structure that emits light and/or otherwise includes at least one light source. Thus, a lamp is not limited to conventional bulbs/lamps (i.e., incandescents, fluorescents, halogens, arc lights, gas-powered lights, etc.), but also includes any type of device including at least one solid state light source (i.e., light emitting diode (LED), organic light emitting diode (OLED), polymer light emitting diode (PLED), and the like). Of course, any combination of any of these light sources may also serve as a light source for a lamp.

Figure 1:
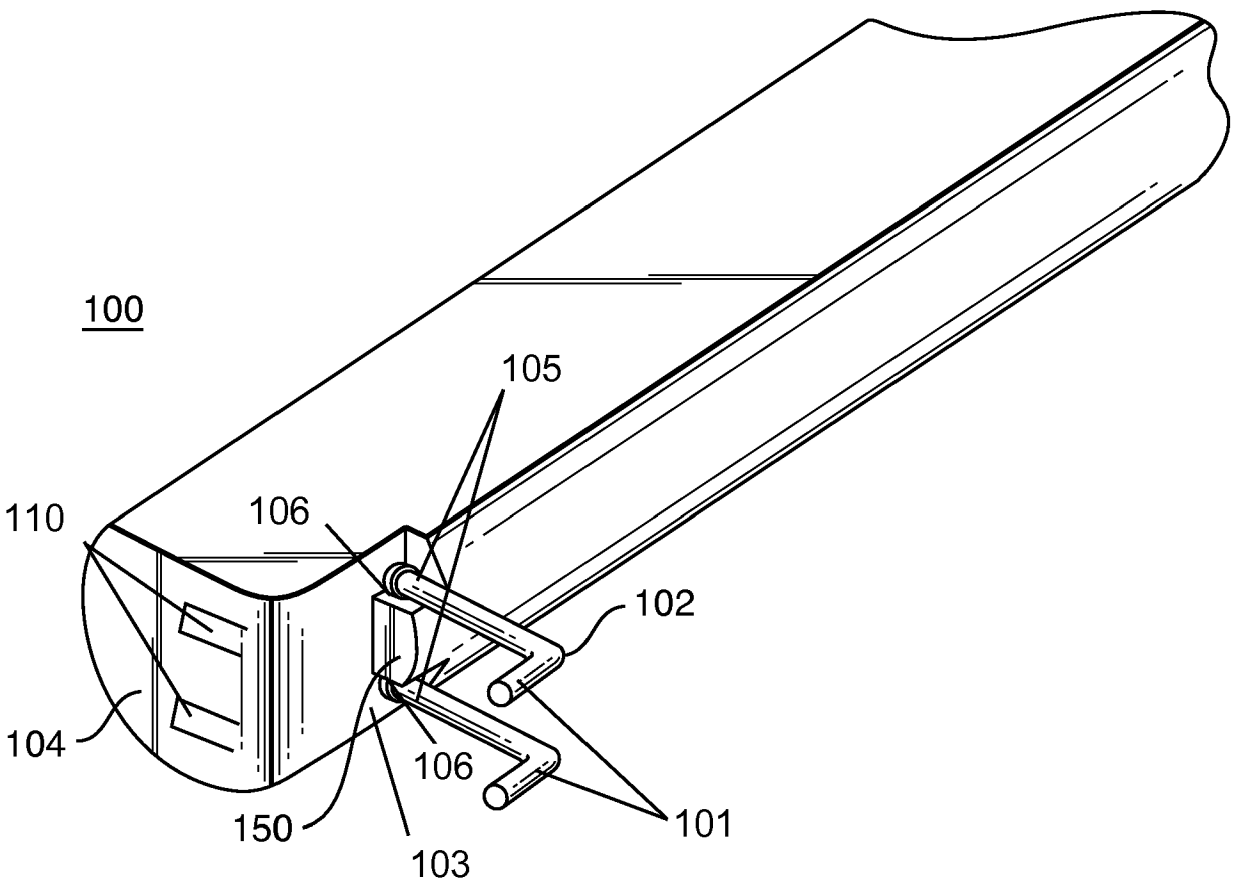
FIG. 1 shows a swinging connector for a lamp, according to embodiments described herein.
Figure 2:
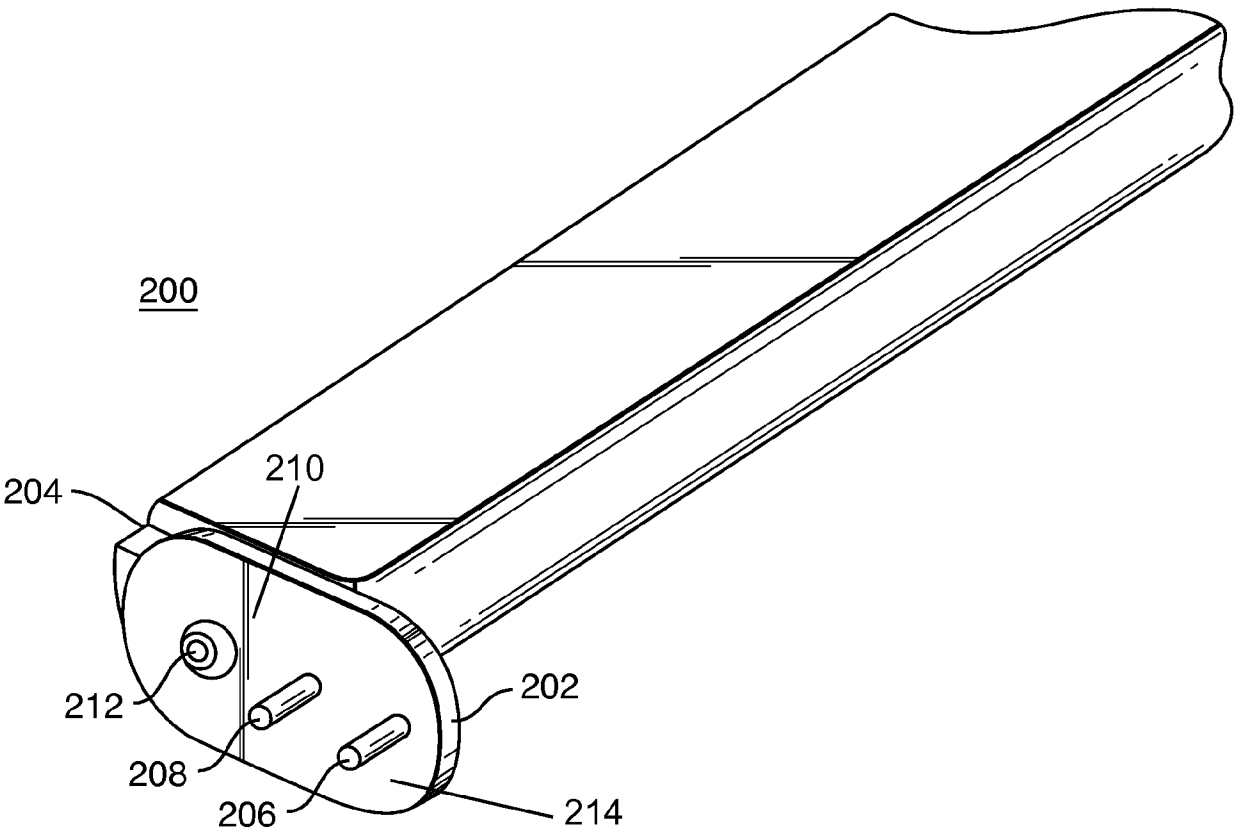
FIG. 2 shows a rotatable connector for a lamp, according to embodiments described herein.

Thus, all lamps shown in FIGS. 1-2 include at least one light source, though no light sources are shown in FIGS. 1-2. The at least one light source may be any known type of light source, including but not limited to so-called traditional light sources (i.e., incandescent, halogen, fluorescent, gas discharge, arc, etc.) and solid state light sources (i.e., light emitting diodes (LEDs), organic light emitting diodes (OLEDs), etc.) and the like, and any combinations thereof.

Though FIGS. 1-2 show embodiments of lamp connectors where the illustrated lamp is, in whole or in part, composed of a substantially linear portion, embodiments are not so limited to just linear and/or partially linear structures. Rather, embodiments may be applied to any type of lamp that requires connection to one, and/or more than one, socket, base, or other receptacle capable of holding one, and/or more than one, lamp and/or light-emitting source, and providing power (electrical or otherwise) thereto.

The term "end cap", as used herein, refers to a conventional end cap as found on a conventional linear fluorescent lamp as well as on some solid state light source-based fluorescent style/shaped lamps, as well as any conventional structure on a lamp that includes an electrical connection to a power source.

FIG. 1 shows a lamp 100. The lamp 100 includes a first exterior surface 103 and a second exterior surface 104. In some embodiments, such as shown in FIG. 1, the first exterior surface 103 and the second exterior surface 104 may be adjacent and/or substantially adjacent each other. Alternatively, or additionally, in other embodiments, there may be one or more other surfaces therebetween. Further, in some embodiments, the first exterior surface 103 and the second exterior surface 104 may be orthogonal one another, and/or substantially orthogonal one another. Thus, in some embodiments, the first exterior surface 103 and the second exterior surface 104 may form, at least partially, an end of a lamp.

The lamp 100 also includes a swinging connector 102, which allows the lamp 100 to be electrically connected to a socket. The swinging connector 102 is operative to have a number of positions. In a first position, the swinging connector 102 is close in proximity to the lamp 100. Thus, in the first position, the swinging connector 102 may be adjacent to the lamp 100. Alternatively, or additionally, in the first position, the swinging connector 102 may be substantially adjacent to the lamp 100. Further, in some embodiments, in the first position, the swinging connector 102 may be flush with the lamp 100. More specifically, the swinging connector 102 may be flush with at least one of the first exterior surface 103 and the second exterior surface 104. In some embodiments, the swinging connector 102 may be flush with both the first exterior surface 103 and the second exterior surface 104. Of course, in some embodiments, the swinging connector 102 may be substantially flush with either or both of the first exterior surface 103 and the second exterior surface 104, respectively.

In a second position, at least a portion of the swinging connector 102 is at a distance from the lamp 100. One possible second position is shown in FIG. 1, wherein a first end 101 of the swinging connector 102 that is operable to couple to a socket for the lamp 100 is at a distance from the lamp 100. In some embodiments, while in the second position, the swinging connector 102 couples to a socket for the lamp 100, providing electrical power to the lamp 100. A second end 105 of the swinging connector 102 is adjacent to the lamp 100. In the embodiment shown in FIG. 1, the second end 105 of the swinging connector 102 is coupled to the lamp 100. More particularly, the second end 105 is coupled to a pivot connection point 106. The pivot connection point 106 is disposed on the first exterior surface 103. In some embodiments, such as is shown in FIG. 1, the first exterior surface 103 includes a protrusion 150, and the pivot connection point 106 is disposed on the protrusion 150. The swinging connector 102 is operable to swing (i.e., pivot) between at least the first position and the second position via the coupling of the swinging connector 102 to the pivot connection point 106. That is, the pivot connection point 106 allows the swinging connector 102 to swing (i.e., pivot) between a plurality of positions. Thus, in some embodiments, the pivot connection point 106 may be an opening capable of receiving the second end 105 of the swinging connector 102, while allowing the swinging connector 102 to pivot and simultaneously retaining the second end 105 in the opening. Thus, the pivot connection point 106 may be any mechanism that permits the swinging connector 102 to swing/pivot.

Of course, in some embodiments, such as shown in FIG. 1, where the swinging connector 106 includes multiple points of connection (i.e., the two first ends 101) to a socket, there may be multiple pivot connection points 106, 107, one for each point of connection of the swinging connector 102. In such embodiments, the swinging connector 102 may move as a single piece (i.e., all points of connection move simultaneously when one point of connection is moved) or the points of connection of the swinging connector 102 may each move distinctly, or subsets of the points of connection may move simultaneously while other subsets move distinctly.

In some embodiments, at least a portion of the second exterior surface 104 may be shaped to receive the swinging connector 102 when the swinging connector 102 is in the first position. Thus, for example, with the type of swinging connector 102 shown in FIG. 1, the second exterior surface 104 may include two slots 110 (i.e., openings) shaped so as to receive at least a portion of the two first ends 101 of the swinging connector 102. The two first ends 101 of the swinging connector 102 are located in their respective two slots 110 when the swinging connector 102 is in the first position. Thus, the two slots 110 are empty when the swinging connector 102 is in the second position. In some embodiments, the two slots 110 are shaped so as to both receive and retain the swinging connector 102 in the first position, when the swinging connector 102 is placed in the first position.

FIG. 2 show a lamp 200 with at least one end 204. The at least one end 204 includes a central portion 210. The central portion 210 is that portion of the at least one end 204 that includes an axis extending in the same direction as the lamp 200 and that passes through the center of the lamp 200. Thus, the central portion 210 includes a point that is located on an exterior of the at least one end 204 at the center of the at least one end 204 if the at least one end 204 is considered as a two-dimensional shape. A rotation mechanism 212 is disposed on the at least one end 204. A rotatable connector 202 is attached (i.e., coupled) to the lamp 200 (more specifically, to the at least one end 204) via the rotation mechanism 212. Thus, the rotation mechanism 212 is any mechanism that allows the rotatable connector 202 to at least partially rotate in a direction. In some embodiments, the rotation mechanism 212 is operative to allow the rotatable connector 202 to rotate in relation to the lamp 200 (i.e., the rotatable connector 202 is able to rotatably move (i.e., rotate) while the lamp 200 remains still). In some embodiments, the rotation mechanism 212 is operative to allow the lamp 200 to rotate in relation to the rotatable connector 202 (i.e., the lamp 200 is able to rotatably move (i.e., rotate) while the rotatable connector 202 remains still). In some embodiments, the rotation mechanism 212 thus allows rotational movement of the rotatable connector 202 through all three hundred sixty degrees of arc in a circle, while in other embodiments, the rotation mechanism 212 allows limited rotational movement (i.e., movement through some subset of the three hundred sixty degrees of arc in a circle (e.g., 120° of arc of movement, 180° of arc of movement, etc.)). In some embodiments, the rotational position of the lamp 200 may be fixed at a certain position (i.e., degree of arc). Alternatively, or additionally, the rotation mechanism 212 may include a ratcheting mechanism, such that the rotatable connector 202 rotates between a plurality of preset positions (i.e., degrees of arc).

The rotatable connector 202 includes a surface 214 and at least one pin 206. In some embodiments, such as shown in FIG. 2, the rotatable connector 202 includes two pins 206, 208, though of course any number of pins and/or other socket connector(s) may be used without departing from the scope of the invention. The at least one pin 206 protrudes from the surface 214, such that it may be placed into a receiving socket. The at least one pin 206 is located on the surface 214 such that it is offset some distance from the central portion 210. In embodiments where there are two pins 206, 208, the two pins 206, 208 are each offset some distance from the central portion 206. This allows, in some embodiments, more possible movement given a particular fixture and/or luminaire into which the lamp 200 may be placed. In some embodiments, such as shown in FIG. 2, the rotation mechanism 212 may be disposed on the at least one end 204 of the lamp 200 substantially near the central portion 212. Alternatively, or additionally, the rotation mechanism 212 may be disposed on the at least one end 204 of the lamp 200 offset a distance from the central portion 212.

In some embodiments, the lamp 200 includes two rotatable connectors 202 (not shown in FIG. 2), one rotatable connector is on a first end of the lamp 200, and the other rotatable connector is on the opposite end of the lamp 200. In some such embodiments, the rotation mechanism for each of the rotatable connectors 202 may be offset at a different distance from the central portion of its respective end of the lamp 200. To allow the lamp 200 to fit into its socket, the respective surfaces 214 (and thus the bodies) of the rotatable connector 202 will be of different lengths.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lamp, comprising:

a first exterior surface and a second exterior surface;

a pivot connection point, wherein the pivot connection point is disposed on the first exterior surface; and a swinging connector coupled to the pivot connection point, the swinging connector being operative to pivot between a first position close in proximity to the lamp and a second position at a distance away from the lamp.

2. The lamp of claim 1, wherein the first exterior surface and the second exterior surface are adjacent one another.

3. The lamp of claim 2, wherein the first exterior surface and the second exterior surface are substantially orthogonal one another.

4. The lamp of claim 1, wherein the first exterior surface includes a protrusion, and wherein the pivot connection point is disposed on the protrusion.

5. The lamp of claim 1, wherein at least a portion of the second exterior surface is shaped to receive the swinging connector when the swinging connector is in the first position.

6. The lamp of claim 1, wherein at least a portion of the second exterior surface is shaped to receive and retain the swinging connector when the swinging connector is in the first position.

7. The lamp of claim 1, wherein the first position includes at least a portion of the swinging connector being flush to the first exterior surface.

8. The lamp of claim 7, wherein the first position includes at least a portion of the swinging connector being flush to the second exterior surface.

9. The lamp of claim 8, wherein at least a portion of the second exterior surface is shaped to receive and retain at least a portion of the swinging connector.

10. The lamp of claim 1, wherein the swinging connector is electrically connected to the lamp.

11. A lamp comprising:

at least one end, wherein the at least one end includes a central portion;

a rotation mechanism disposed on the at least one end; and a rotatable connector attached to the at least one end via the rotation mechanism, the rotatable connector comprising a surface and at least one pin, wherein the at least one pin protrudes from the surface, and wherein the at least one pin is offset from the central portion.

12. The lamp of claim 11, wherein the rotation mechanism is operative to allow the rotatable connector to rotate in relation to the lamp.

13. The lamp of claim 11, wherein the rotation mechanism is operative to allow the lamp to rotate in relation to the rotatable connector.

14. The lamp of claim 11, wherein the rotation mechanism is disposed on the at least one end substantially near the central portion.

15. The lamp of claim 11, wherein the rotation mechanism is disposed on the at least one end offset from the central portion.

* * * * *